US012459768B2

(12) United States Patent
Nemura et al.

(10) Patent No.: US 12,459,768 B2
(45) Date of Patent: Nov. 4, 2025

(54) MEDIA PROCESSING DEVICE CONFIGURED TO REDUCE MEDIA WASTE

(71) Applicant: ZEBRA TECHNOLOGIES CORPORATION, Lincolnshire, IL (US)

(72) Inventors: Blake E. Nemura, Saint Charles, IL (US); Christopher Ensign, Volo, IL (US); Richard E. Bergstrom, Lake Villa, IL (US)

(73) Assignee: Zebra Technologies Corporation, Lincolnshire, IL (US)

( * ) Notice: Subject to any disclaimer, the term of this patent is extended or adjusted under 35 U.S.C. 154(b) by 166 days.

(21) Appl. No.: 18/104,637

(22) Filed: Feb. 1, 2023

(65) Prior Publication Data

US 2024/0253922 A1 Aug. 1, 2024

(51) Int. Cl.
*B65H 7/02* (2006.01)

(52) U.S. Cl.
CPC ..... *B65H 7/02* (2013.01); *B65H 2511/11* (2013.01); *B65H 2801/03* (2013.01)

(58) Field of Classification Search
CPC ..... B65H 2701/192; B65H 2701/194
See application file for complete search history.

(56) References Cited

U.S. PATENT DOCUMENTS 12,053,994 B2 * 8/2024 Buthrath ..... B41J 11/0095
2021/0142020 A1 * 5/2021 Casavant ..... G06K 19/06028

FOREIGN PATENT DOCUMENTS

WO WO-2020196519 A1 * 10/2020 ..... B41J 11/0095

* cited by examiner

*Primary Examiner* — Howard J Sanders

(57) ABSTRACT

Disclosed is a media processing device, including a printing assembly located downstream of a media supply. The media supply includes media elements. The media processing device further includes a memory configured to store media profiles and an edge detection sensor configured to detect edges of the media elements. The edge detection sensor is located proximate to an upstream end of the printing assembly. The media processing device further includes a control circuit configured to receive a media profile, determine calibration data based on the media profile, feed a first media element through the printing assembly, determine a media element length based on the media profile, retract the first media element back through the printing assembly based on the media element length, and print on the first media element by way of the printing assembly.

20 Claims, 8 Drawing Sheets

MEDIA PROCESSING DEVICE CONFIGURED TO REDUCE MEDIA WASTE

BACKGROUND

Printers configured for printing labels often require an initial setup of the labels at the time the labels are loaded into the printers. Once the printers print on the labels, the labels can be placed on objects, such as packages for shipping, products for sale at retail, stock shelf labels, etc. The labels may be provided on various types of media, such as a roll or stack, and the labels may come in different sizes (e.g., different shapes, lengths and/or widths) which may be printed by the same printer.

BRIEF DESCRIPTION OF THE SEVERAL VIEWS OF THE DRAWINGS

The novel features of the various aspects are set forth with particularity in the appended claims. Throughout the FIGS. like reference characters designate like or corresponding parts throughout the several views of the drawings. The described aspects, however, both as to organization and methods of operation, may be best understood by reference to the following description, taken in conjunction with the accompanying drawings in which:

Figure 1:
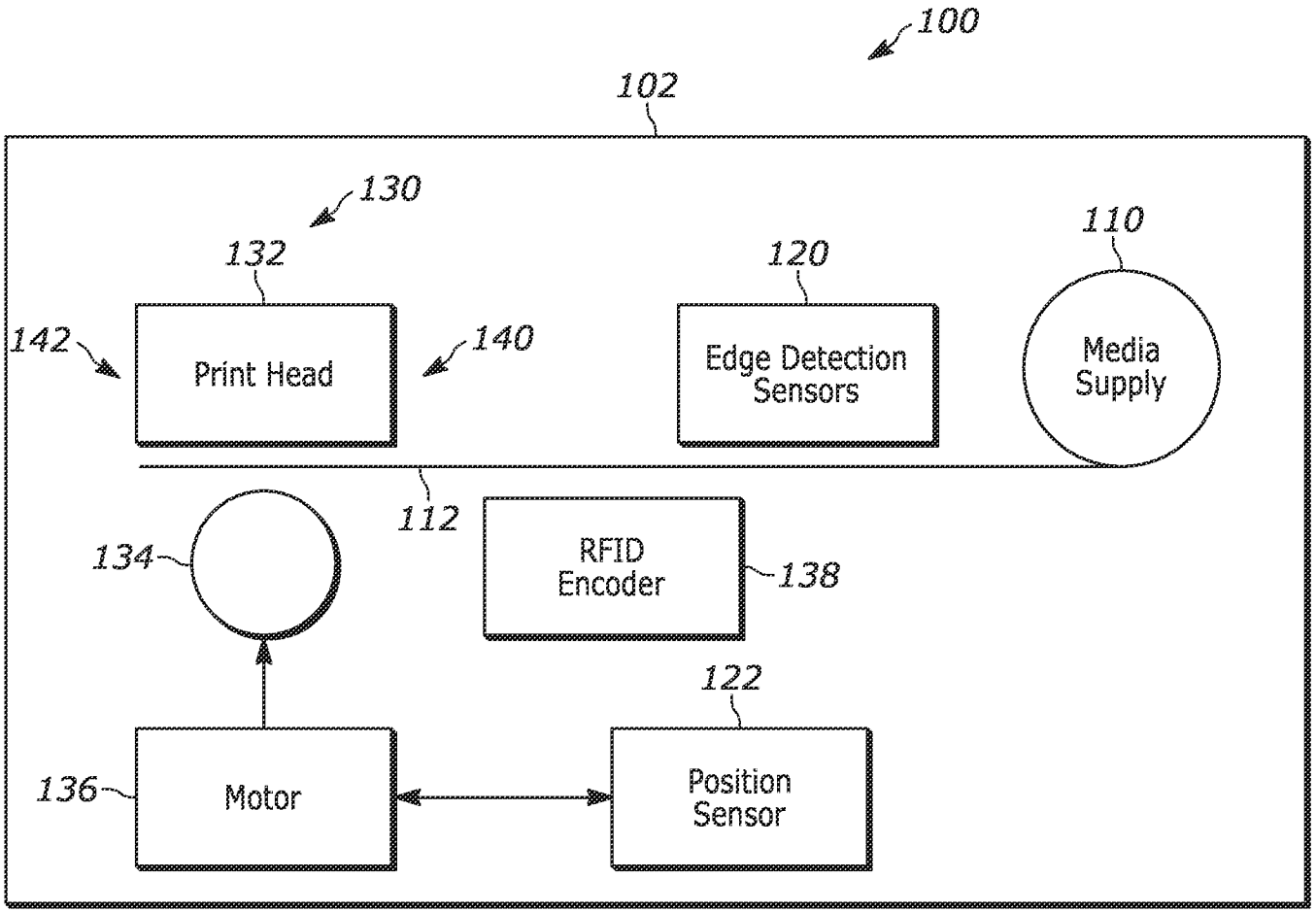
FIG. 1 is a schematic of a media processing device with a media supply loaded, according to at least one aspect of the present disclosure.

The apparatus and method components have been represented where appropriate by conventional symbols in the drawings, showing only those specific details that are pertinent to understanding the embodiments of the present disclosure so as not to obscure the disclosure with details that will be readily apparent to those of ordinary skill in the art having the benefit of the description herein.

DETAILED DESCRIPTION

The following detailed description of example implementations refers to the accompanying drawings. The same reference numbers in different drawings may identify the same or similar elements.

In media processing devices, a first media element is generally fed through a media processing device upon a new media supply being loaded into the device. This process is done so that the media processing device can be calibrated to the new media supply. Generally, as part of conventional calibration or setup processes, the first media element fed through the media processing device is presented blank at an output of the media processing device, at which point the first media element is removed from the media supply and discarded as waste. These media elements may also include RFID tags to be encoded by the media processing device, where the RFID tag of the first media element typically also cannot be encoded. After calibration is complete, the media processing device can begin printing on and/or encoding different media elements from the media supply. As result, conventional calibration processes can result in substantial waste over time.

To conserve the media elements and avoid wasting the first media element, embodiments of the media processing device of the present disclosure can be configured to be calibrated to a new media supply so that the media processing device can utilize the first media element for a printing operation and/or an encoding operation. The media processing can store media profile data for a media supply and use that profile data to retract the first media element after it has been fed through the media processing device, where it may be presented at the output of the media processing device. For example, the media processing device can automatically prompt a user to select a media profile upon detecting that a new media supply has been loaded. Then the media processing device can retract the first media element based on the selected media profile.

The media processing device and control system described herein reduce calibration media waste which provides the benefit of conserving the media supply. In some aspects, a user desires to change media supplies often and always wasting a media element of the media supply each change can have the user waste multiple media elements through the use of the media supply. In some aspects, the media supply could be changed by an automated system with the same issue occurring. In at least one aspect, the control system also provides the benefit of easily allowing the user to select a new media supply by automatically prompting the user to select a media supply upon the control system detecting a new media supply being loaded. In this aspect, the media processing device automatically navigates to the appropriate menu for the user. The control system is also configured to store calibration data, which allows the user to avoid having to perform a full media calibration every time a media supply is loaded into the media processing device.

Examples disclosed herein are directed to a media processing device having a printing and/or encoding assembly, which can include a print head and/or an RFID encoder, and may be simply be referred to herein as a printing assembly, which should be understood as including a print head and/or an RFID encoder. The printing assembly located downstream of a media supply. The media supply includes media elements arranged end-to-end in a continuous strip. The printing assembly is configured to sequentially receive the plurality of media elements at an upstream end of the printing assembly, sequentially feed the plurality of media elements past the printing assembly, and sequentially eject the plurality of media elements from a downstream end of the printing assembly. The media processing device further comprises a memory configured to store media profiles and an edge detection sensor configured to detect edges of the media elements, wherein the edge detection sensor is located proximate to the upstream end of the printing assembly. The media processing device also includes a control circuit configured to receive a media profile for the media supply, wherein the media profile corresponds to media profile data. The control circuit is further configured to determine calibration data based on the media profile data, feed a first media element of the media elements of the strip through the printing assembly and downstream of the print head to a presentation position, and determine a media element length from the media profile data. The control circuit is further configured to retract the first media element back through the printing assembly based on the media element length, print on the first media element by way of the printing assembly.

Additional examples disclosed herein are directed to a method that includes detecting a media supply being loaded into a media processing device, wherein the media supply includes media elements arranged end-to-end in a continuous strip. The method also includes receiving a media profile for the media supply, determining calibration data based on the media profile stored in a memory of the media processing device, and determining a media element length from the media profile. The method further includes feeding a first media element of the media elements of the continuous strip through a printing assembly and downstream of the printing assembly to a presentation position, retracting the first media element back through the printing assembly based on the media element length, printing on the first media element by way of the printing assembly, and/or encoding, for example, a RFID tag included in the first media element by way of the printing assembly.

Additional examples disclosed herein are directed to a media processing device that includes a user display, a printing assembly located downstream of a media supply. The media supply includes media elements arranged end-to-end in a continuous strip. The printing assembly configured to sequentially receive the media elements at an upstream end of the printing assembly, sequentially feed the media elements past the printing assembly, and sequentially eject the media elements from a downstream end of the printing assembly. The media processing device further includes a memory configured to store media profiles and an edge detection sensor configured to detect edges of the media elements, wherein the edge detection sensor is located proximate to the upstream end of the printing assembly. The media processing device further includes a housing configured to house the printing assembly and the media supply, wherein the housing is configured to move from a closed configuration to an open configuration to allow a new media supply to be loaded. The media processing device also includes a housing sensor configured to determine if the housing is in the open configuration or the closed configuration and a control circuit. The control circuit is configured to detect the housing being in the open configuration, automatically render a prompt on the user display for a user to input a media profile of the media profiles in response to the housing being in the open configuration, and receive a selected media profile from the user for the media supply. The control circuit is further configured to determine calibration data based on the selected media profile, feed a first media element of the media elements of the strip through the printing assembly and downstream of the printing assembly to a presentation position, and determine a media element length from the selected media profile. The control circuit is further configured to retract the first media element back through the printing assembly based on the media element length, print on the first media element by way of the printing assembly, and/or encode, for example, a RFID tag included in the first media element.

The media processing device may be used in a variety of applications to provide printed content on media elements, such as labels, paper, wristbands, webbing, and the like, and/or to encode RFID tags included in the media elements. As one non-limiting example, the media processing device can print labels that are to be associated with objects in order to provide and/or indicate information associated with the objects (e.g., products, inventory, samples, supplies, consumables, and/or the like). In some instances, another device or system (e.g., a barcode reader or other type of device) may be configured to read the labels in order to process the objects (e.g., to identify the objects, to sort the objects, to select the object for transportation, or to perform some other activity involving the object).

In some aspects, the media processing device can be embodied as a thermal printer that is configured to print content on thermal sensitive media using a thermal print head. The thermal print head may include an array of printing elements that print the content to the thermal sensitive media based on respective resistances of the printing elements (e.g., one or more resistors or other components with resistive properties) as the thermal sensitive media passes or comes into contact with the printing elements. The printer may cause the printing elements to have respective resistances according to print data associated with a printing instruction and/or printing operation.

FIG. 1 is a schematic of a media processing device 100 with a media supply 110 loaded, according to at least one aspect of the present disclosure. The media processing device 100 includes a housing 102, a printing assembly 130, one or more edge detection sensors 120, and a motor 136. In at least one aspect, a media supply 110 is loaded into the housing 102 of the media processing device 100 upstream of the printing assembly 130. In an alternative aspect, the media supply 110 is located outside of the housing 102 and upstream of the printing assembly 130. The media supply 110 can be stored in different forms, for example as a roll or in a fan fold configuration. In any form, the media supply 110 includes media elements arranged end-to-end in a continuous strip 112. In some aspects, the media elements include radio frequency identification (RFID) inlays. In one aspect, the ends of the media elements on the continuous strip 112 abut. In an alternative aspect, there is a space, or gap, between the ends of the media elements in the continuous strip 112. Additionally, when the media elements of the media supply 110 are disposed on a liner, the media elements can be removed from the liner before, after, or at the time the medial elements are ejected from the media processing device 100. When the media elements of the media supply 110 are linerless or devoid of a liner, the media elements are themselves connected to each other to form the strip and can be separated from each other before, after, or at the time the medial elements are ejected from the media processing device 100. The media supply 110 may include notches, markers, or other indicia disposed on or proximate to the media elements to delineate the edges of the media elements in the continuous strip 112.

The continuous strip 112 is fed from the media supply 110 downstream through the printing assembly 130. The printing assembly 130 has an upstream end 140 and a downstream end 142. The printing assembly 130 is configured to sequentially receive the media elements at the upstream end 140 of the printing assembly 130, sequentially feed the media elements past the printing assembly 130, and sequentially eject the media elements from the downstream end 142 of the printing assembly 130 to a presentation position. In some aspects, the downstream end 142 is proximate an exit out of the housing 102 such that the media elements are ejected out of the housing 102 to a presentation position outside of the housing 102. The edge detection sensors 120 are located proximate the upstream end 140 of the printing assembly 130. In at least one aspect, the one or more edge detection sensors 120 comprise a sensor located proximate the upstream end 140 above or below the continuous strip 112. In some aspects, the one or more edge detection sensors 120 comprise sensors located proximate the upstream end 140 above and/or below the continuous strip 112.

The printing assembly 130 includes a print head 132 and a platen 134. The platen 134 can be located below and proximate to the downstream end 142 of the printing assembly 130, for example, immediately opposite the print head 132. When the media supply 110 is loaded into the media processing device 100, the continuous strip 112 of the media supply 110 is placed into the upstream end 140 of the printing assembly 130 between the printing assembly 130 and the platen 134. In one aspect, the end of the continuous strip 112 is located between the print head 132 and the platen 134. The printing assembly 130 and the platen 134 compress the continuous strip 112 such that as the motor 136 rotates the platen 134 and the platen 134 moves the media element in the continuous strip 112 in an upstream or downstream direction. Media elements exit the printing assembly 130 at the downstream end 142. As a non-limiting example, when the media supply 110 is initially loaded into the media processing device, a first one of the media elements in the strip 112 can be positioned between the print head 132 and the platen 134 so that the platen 134 can engage the media supply 110 and operate to move the media elements in the strip 112 as described herein. As such, a leading edge of a first media element of the continuous strip 112 is typically positioned downstream of the edge detection sensors 120 and downstream of the platen 134 during the initial setup, while a trialing edge of the first media element may be upstream of the platen 134 and upstream of the edge detection sensors 120 such that the media processing device may not be able to determine the position of the first media element is relative to the print head.

In some aspects, the printing assembly 130 also includes an RFID encoder 138 in the alternative to or in addition to the print head 132. For embodiments that include both the print head 132 and the RFID encoder 138, the RFID encoder 138 can be located proximate the printing head 132. In one aspect, the RFID encoder 138 is located on the opposite side of the continuous strip 112 from the print head 132. In an alternative aspect, the RFID encoder 138 is located on the same side of the continuous strip 112 as the print head 132. The RFID encoder 138 is configured to encode data onto, for example, RFID inlays in the media elements. In at least one aspect, the RFID encoder 138 is configured to move relative to the continuous strip 112 to be able to move to an appropriate location to encode an RFID inlay in a media element.

The motor 136 is configured to rotate the platen 134. In at least one aspect, the motor 136 is coupled to the platen 134 such that a movement of the motor 136 causes a rotation of the platen 134. This process can be done through a variety of methods. For example, the motor 136 can be coupled to the platen 134 directly or through a system such as a drive train formed by gears, belts, and/or other components, such as pistons. The motor 136 and the printing assembly 130 work in sync to print on the plurality of media elements on the continuous strip 112. In at least one aspect, the motor 136 can be coupled to a position sensor 122 that is configured to collect data indicative of the distance the motor has rotated. In an alternative aspect, the control input to the motor 136 can be used to determine the distance the motor 136 rotated. For example, the motor 136 can be a stepper motor and the input to the stepper motor can be the amount of steps to rotate which corresponds to a distance rotated. In either aspect, the distance the motor rotated is related to an amount of the continuous strip 112 moved upstream or downstream.

The media elements in the continuous strip 112 of the media supply 110 can be any shape or size. FIGS. 2A-2F show some non-limiting examples of media elements 302 on a continuous strip 112. For the sake of brevity, not all possibly configurations for the media elements 302 and continuous strip 112 are discussed. The media elements 302 in FIGS. 2A-2E are shown as rectangular; however, the media elements 302 can be any shape. For example, the media elements 302 can be oval, square, circular, an abstract shape, or any other shape. While FIGS. 2A-2E illustrate a gap 310 between the media elements 302, the media elements can abut each other without a gap 310. The one or more edge detection sensors 120 are configured to detect an edge 304 of a media element 302. For example, the one or more edge detection sensors 120 are configured to detect delineating features between the media elements 302. In at least one aspect, the edge detection sensors 120 include a plurality of sensors configured to detect different indications of the edge 304 of the media elements 302. In at least one aspect, the edge detection sensor 120 is only one sensor that is configured to detect different indications of the edge 304 of the media elements 302.

Figure 2A:
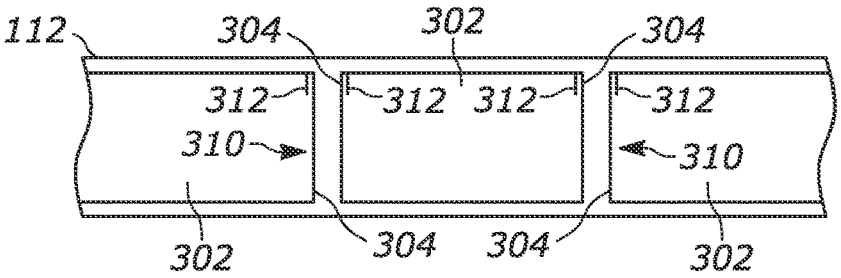
FIGS. 2A-2F are diagrams of a continuous strip of a media supply, according to at least one aspect of the present disclosure.
Figure 2B:
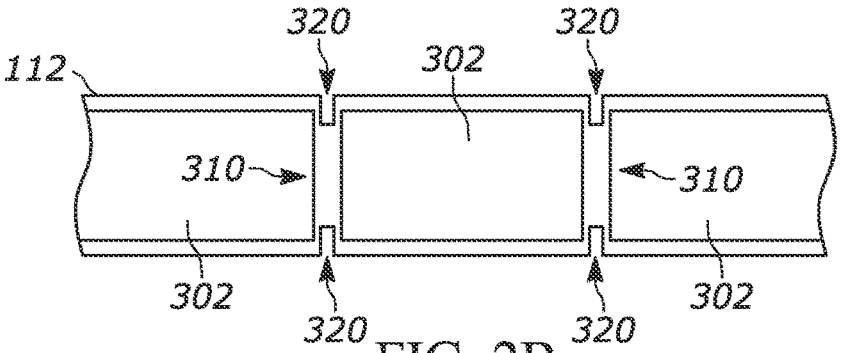

Referring to FIG. 2A, in one aspect, a sensor of the edge detection sensors 120 is configured to detect edges 304 of the media elements 302. For example, the sensor can detect a mark 312, or other indication, on the media element 302 indicating the edge 304. Referring to FIG. 2B, the continuous strip 112 can have notches 320 between the media elements 302. In this aspect, a sensor of the edge detection sensors 120 is configured to detect the notches 320 on the continuous strip 112. For example, a transmissive sensor can be used to detect a notch 320 on the continuous strip 112.

Figure 2C:
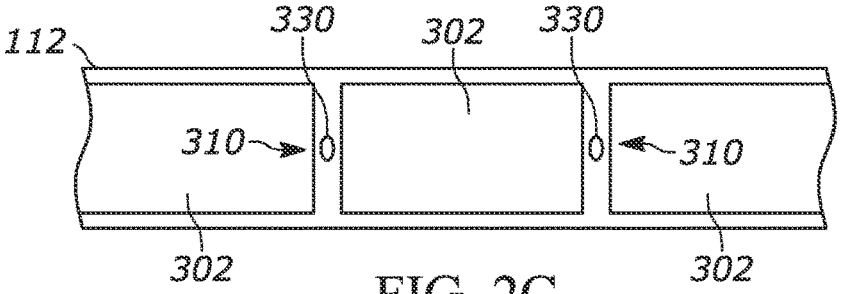

Referring to FIG. 2C, the continuous strip 112 can have holes 330 between the media elements 302. In this aspect, a sensor of the edge detection sensors 120 is configured to detect the holes 330 on the continuous strip 112. For example, a transmissive sensor can be used to detect a hole 330 on the continuous strip 112.

Figure 2D:
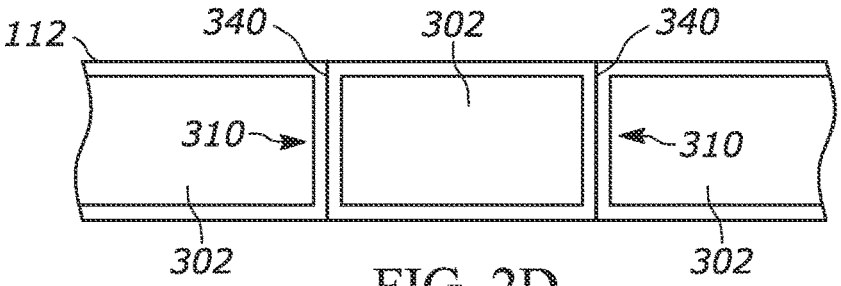
Figure 2E:
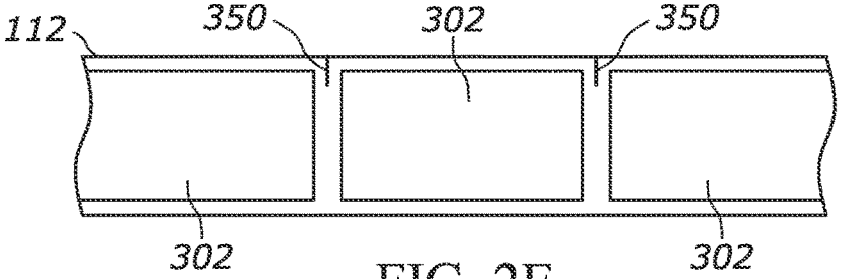

The continuous strip 112 can have marks between the media elements 302. FIG. 2D illustrates marks 340 that span the entire width of the continuous strip 112. FIG. 2E illustrates marks 350 that only span a portion of the width of the continuous strip. In either aspect, a sensor of the edge detection sensors 120 is configured to detect the marks 340, 350 on the continuous strip 112. For example, a reflective sensor can be used to detect a mark on the continuous strip 112.

Figure 2F:
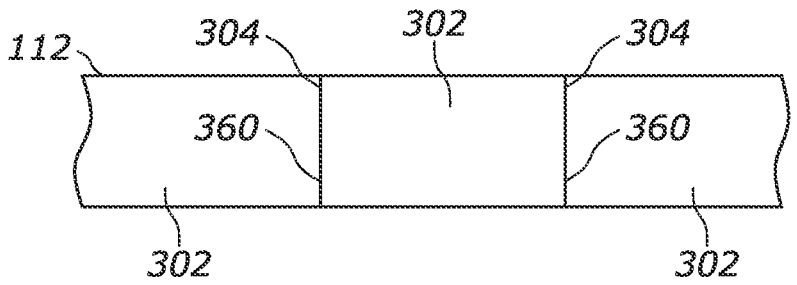

Referring to FIG. 2F, the continuous strip 112 can also be linerless. In this aspect, the media elements 302 abut each other such that two media elements 302 have the same edge 304. A linerless continuous strip 112 can have any delineating feature discussed above, e.g. gap, notch, mark, etc., between the media elements 302. For example, FIG. 2F shows marks 360 indicating the edges 304. In this instance, a sensor of the edge detection sensors 120 is configured to detect the marks 360 on the continuous strip 112 along the edge 304. For example, a reflective sensor can be used to detect a mark on the continuous strip 112.

The edge detection sensors 120 can include a plurality of sensors that allow the detection of marks, holes, notches, etc. on the continuous strip 112 and/or media elements 302. The edge detection sensors 120 allow a control circuit in the media processing device 100 to detect media elements 302 on the continuous strip 112 for different types of continuous strips 112. In at least one aspect, the location of the media elements 302 on the continuous strip 112 are related to the indication marks (marks, holes, notches, etc.) on the continuous strip 112.

Figure 3:
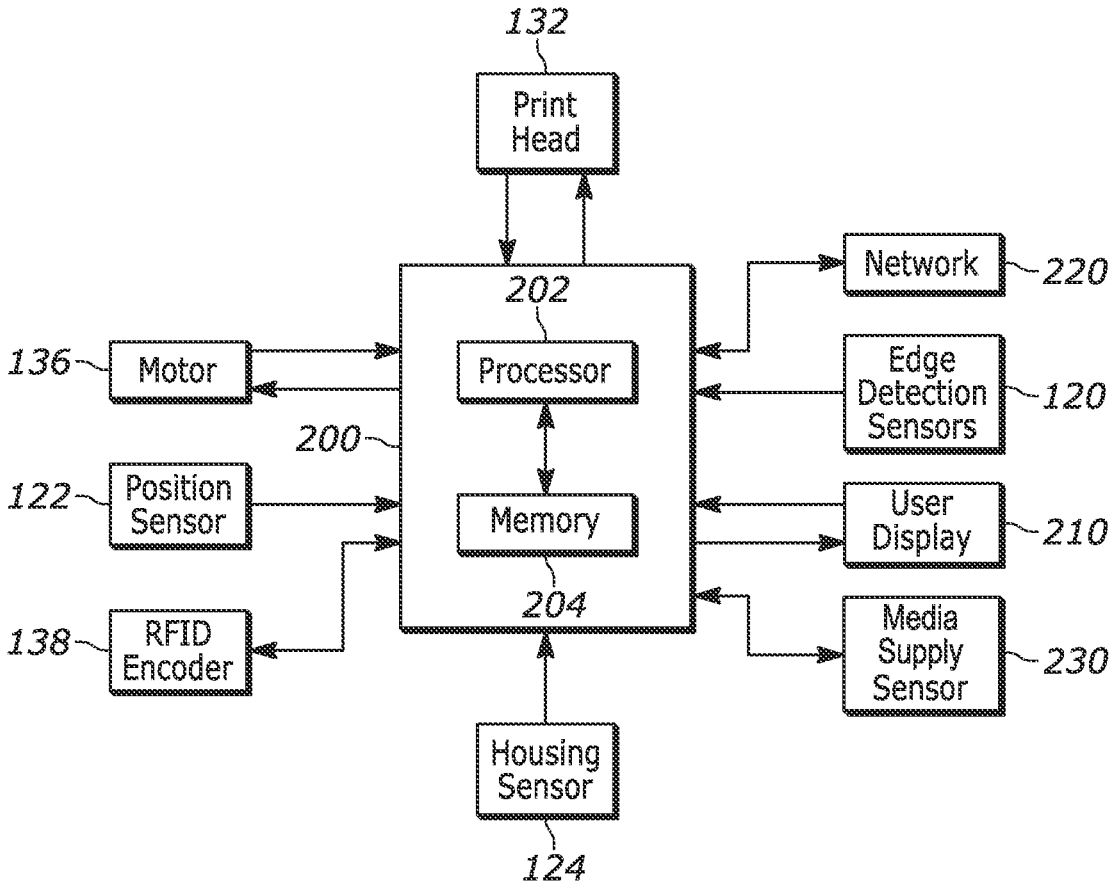
FIG. 3 is a control circuit schematic of the media processing device, according to at least one aspect of the present disclosure.

FIG. 3 is a control diagram of the media processing device 100, according to at least one aspect of the present disclosure. The media processing device 100 includes a control circuit 200 that includes a processor 202 coupled to a memory 204. In at least one aspect, the control circuit 200 can include multiple processors and/or memories. The diagram is showing the control system as only one control circuit 200 for simplicity; however, the control circuit 200 can be broken into multiple control circuits that communicate with each other and are coupled to the systems shown in the diagram.

The control circuit 200 is coupled to the edge detection sensors 120. The control circuit 200 is configured to detect an edge 304 of a media element based on data from the edge detection sensors 120. In some aspects, the control circuit 200 determines the type of continuous strip 112 based on data from the edge detection sensors 120. In at least one aspect, the control circuit 200 is configured to perform a media element calibration. The media sensor calibration involves the control circuit 200 determining an optimal edge detection sensor 120 configuration, e.g. type, brightness, gain, threshold, etc., in order to reliably detect a media presence and media element edges, e.g. gap, notch, mark, etc. In at least one aspect, the media element calibration involves multiple sensor readings at various configurations while moving the continuous strip 112 over the one or more edge detection sensors 120 and this data is algorithmically analyzed by the control circuit 200 to determine results. In one aspect, multiple media element edges need to be seen during the media element calibration before sufficient results are reached.

The media element calibration also involves control circuit 200 using data from the edge detection sensors 120 to determine the length of the media elements 302 on the continuous strip 112. In at least one aspect, the control circuit 200 can determine the amount of continuous strip 112 moved between the detection of a first edge 304 and a second edge 304. For example, the control circuit 200 can detect a first edge of a first media element 302 based on an output from the edge detection sensors 120, feed the continuous strip 112 through the printing assembly 130 until a second edge is detected on a second media element 302 based on the output from the edge detection sensors 120, and determine the media element length of the first media element 302 based on the amount of the continuous strip 112 moved between the detection of the first edge and second edge. In at least one aspect, the size of the delineating feature, e.g. gap, notch, mark, etc., indicating an edge of a media element can also be calculated during the media element calibration. The control circuit 200 is configured to associate the media element calibration data with a media profile and store the media element calibration data in a memory. For example, the control circuit 200 is configured to store the media element length and associate it with the media profile.

The control circuit 200 is coupled to the print head 132. For example, the control circuit 200 can cause the print head 132 to print a label on a media element 302 on the continuous strip 112. In at least one aspect, the media element calibration collects data on the location of the media elements 302 on the continuous strips 112 relative to the indication marks (marks, holes, notches, etc.) that the control circuit 200 can detect based on data from the edge detection sensors 120. This media element calibration data can be used by the control circuit 200 and the print head 132 to print on the media elements 302 in the appropriate location.

In some aspects, the control circuit 200 is coupled to the RFID encoder 138. In at least one aspect, the control circuit 200 is configured to perform an RFID calibration with the RFID encoder 138. During the RFID calibration, the control circuit 200 determines the optimal position to perform RFID operations with the RFID encoder 138 relative to the leading edge of the media element 302. For example, the control circuit 200 can determine the location of the RFID inlays in the media elements 302. This process allows the RFID encoder 138 to be in an optimal position relative to an RFID inlay in the media element 302 during RFID operations. In some aspects, the RFID calibration involves the control circuit 200 performing an antenna selection. For example, the RFID encoder 138 can have a single reader/encoder antenna or the RFID encoder 138 could have a 2-dimension array of antennae. During the RFID calibration, the control circuit 200 also determines an appropriate radio frequency power level. For example, the power level needs to be strong enough to reliably read/write the RFID inlay, but not so strong that it inadvertently activates RFID inlays in adjacent media elements or wastes energy. In at least one aspect, the control circuit 200 determines a minimum RFID power level that allows the RFID encoder 138 to reliable read/write an RFID inlay on a media element 302. The control circuit 200 is configured to store the RFID calibration data in a memory and associate the RFID calibration data with a media profile. The RFID calibration data includes the location of the RFID inlays in the media elements 302, the location that the RFID encoder 138 needs to be in to encode the RFID inlays, the power level to reliable read/write an RFID inlay, and etc. During encoding an RFID inlay, the control circuit 200 is configured to use the RFID calibration data and cause the RFID encoder 138 to encode data onto RFID inlays in a media element 302 in the continuous strip 112.

The control circuit 200 is coupled to the motor 136 to control the movement of the continuous strip 112. In some aspects, the control circuit is coupled to the position sensor 122. The control circuit 200 can use the data from the position sensor 122 to determine the amount of continuous strip 112 moved by the motor 136. In some aspects, the control circuit 200 can determine the amount of continuous strip 112 moved by the motor 136 based on the input to the motor 136. For example, the control circuit 200 can control the motor to move a specified distance or control the motor to move at a specific speed for a given time and then use this information to determine a distance moved by the continuous strip 112.

The control circuit 200 is coupled to a housing sensor 124. The housing 102 is configured to move from a closed configuration to an open configuration. In some aspects, in the open configuration a new media supply 110 is loaded into the housing 102. The housing sensor 124 is configured to collect data indicative of the configuration of the housing. For example, the control circuit 200 can determine if the housing 102 is in an open configuration or a closed configuration based on data from the housing sensor 124.

In some aspects, the user can configure what happens after the control circuit detects a power up and/or a housing 102 close action, e.g. the housing 102 moving from the open configuration to the closed configuration. For example, the user can configure the control circuit 200 to have the media processing device 100 perform no motion of the continuous strip 112, feed a first media element to presentation position, calibrate media element length as discussed herein, perform a full media and/or RFID calibration, or etc. In some instances, the feed a first media element to presentation position is the best option since the calibration/length data can be provided by the media profile, but it is still important to ensure proper edge registration.

The control circuit 200 is coupled to a network 220. In at least one aspect, the control circuit 200 can receive data from the network 220. For example, the control circuit 200 can received from the network 220 a media profile and store the media profile in the memory 204. In at least one aspect, the control circuit 200 can transmit data to the network 220. In at least one aspect, the control circuit 200 of a first media processing device is coupled to a control circuit 200 of a second media processing device through the network 220. For example, the control circuit 200 of a first media processing device can transmit a media profile to the control circuit 200 of the second media processing device through the network 220. In some aspects, the control circuit 200 can be coupled to a removable memory and the control circuit 200 can receive data from the removable memory and transmit data to the removable memory. For example, the control circuit can receive from a removable memory or transmit to a removable memory a media profile.

In some aspects, the control circuit 200 is coupled to a media supply sensor 230. For example, the control circuit 200 can use data from the media supply sensor 230 to determine the type of media supply 110 loaded into the media processing device 100. In at least one aspect, the media supply 110 comprises an RFID tag and the media supply sensor 230 is configured to receive identifying information from the RFID tag. In an alternative aspect, the media supply 110 comprises a label and the media supply sensor 230 is configured to read identifying information from the label. For example, the control circuit 200 can link the identifying information from the media supply 110 with a media profile. In at least one aspect, the control circuit 200 can automatically determine the media profile to use with a media supply 110 based on the identification data received from the media supply sensor 230.

The control circuit 200 is coupled to a user display 210. The control circuit 200 can transmit data to a user through the user display 210. In some aspects, the control circuit 200 can receive an input from a user through the user display 210. For example, the user display 210 can be a touch screen display. In an alternative aspect, the control circuit 200 can receive an input from a user from buttons on the media processing device 100.

Figure 4:
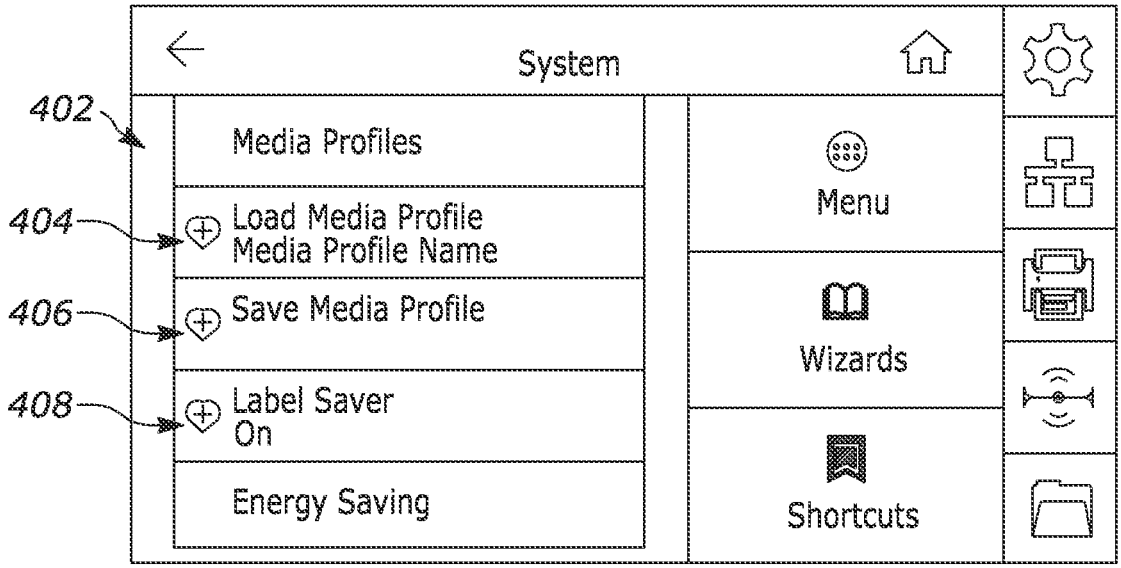
FIG. 4 is an example media profile menu, according to at least one aspect of the present disclosure.
Figure 5:
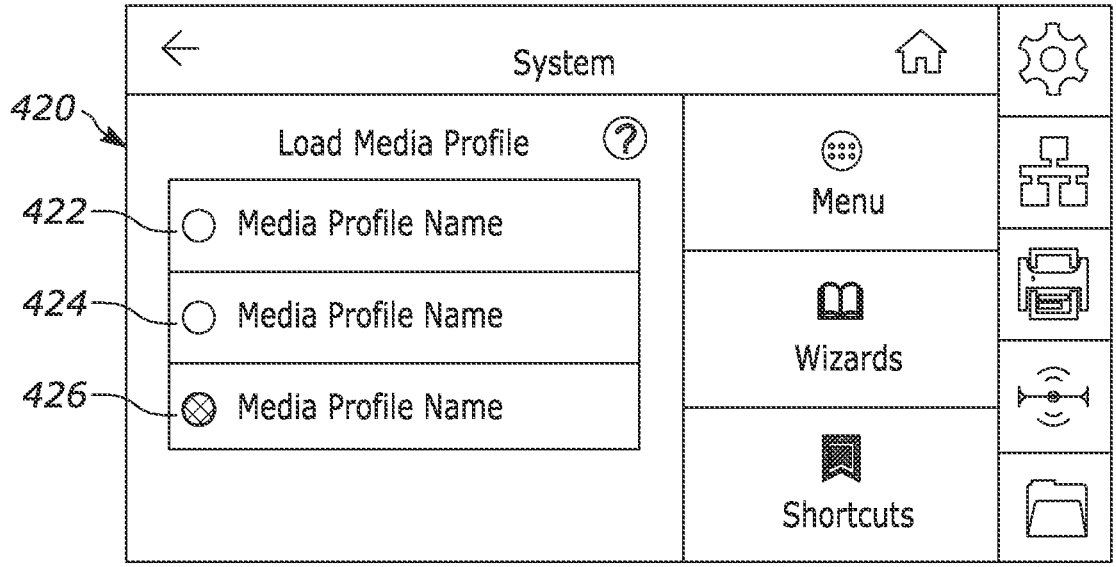
FIG. 5 is an example load media profile menu, according to at least one aspect of the present disclosure.
Figure 6:
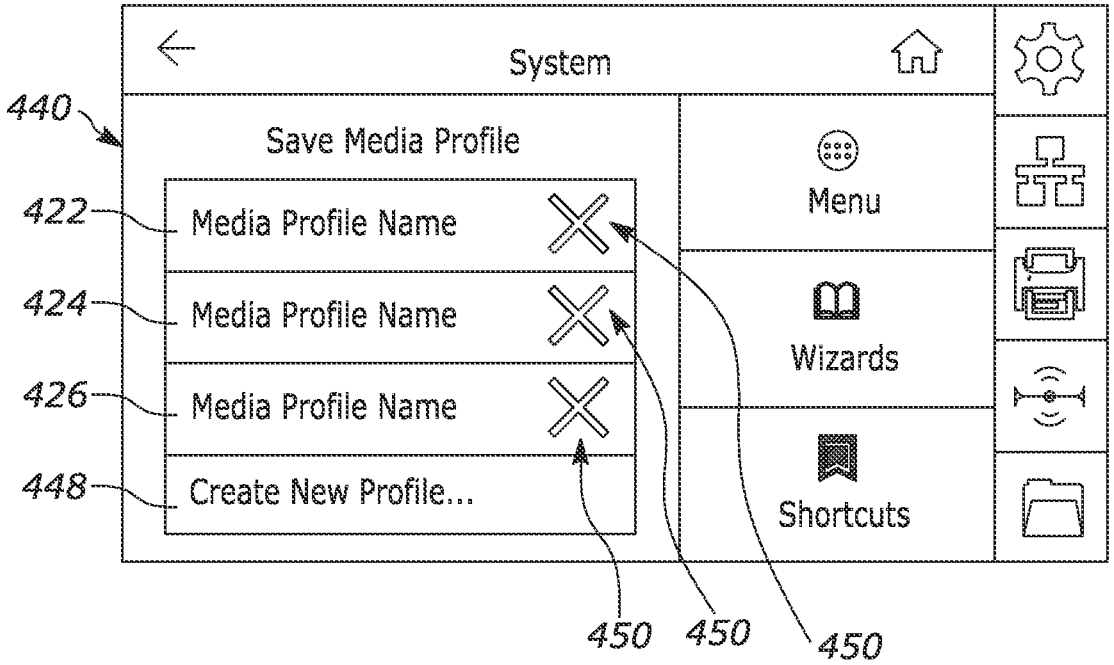
FIG. 6 is an example save media profile menu, according to at least one aspect of the present disclosure.

FIGS. 4-6 illustrate example menus that can be displayed to a user. FIG. 4 is an example media profile menu 402 displayed on a user display 210, according to at least one aspect of the present disclosure. The example media profile menu 402 shows a load media profile selection 404, a save media profile selection 406, and a label saver selection 408. The load media profile selection 404 illustrates the current media profile name that is selected. When the load media profile selection 404 is selected by the user, the user display 210 changes to show the load media profile menu 420 illustrated in FIG. 5. The load media profile menu 420 shows a selection of the names of the stored media profiles. FIG. 5 shows 3 stored media profiles 422, 424, 426. Media profile 426 is the currently selected media profile. When the save media profile selection 406 (FIG. 4) is selected by the user, the user display 210 changes to show the save media profile menu 440 illustrated in FIG. 6. The save media profile menu 440 shows the names of the stored media profiles. FIG. 6 shows 3 stored media profiles 422, 424, 426. In the save media profile menu 440, the user can select the delete 450 to remove one of the stored media profiles 422, 424, 426. As shown in FIG. 6, the each media profile 422, 424, 426 has a delete 450 associated with it. The save media profile menu 440 has a create new profile selection 448.

In at least one aspect, upon the user selecting the create new profile selection 448, the control circuit 200 receives an input requesting a new media profile be created for the media supply 110. In one aspect, the control circuit 200 stores the current media element calibration and the current RFID calibration and associates the calibration data with the new media profile. In an alternative aspect, the control circuit 200 automatically prompts the user to perform a new media element calibration and a new RFID calibration. For example, the user can manually calibrate, or otherwise configure, the media processing device 100 as desired for the loaded media supply 110. In yet another alternative aspect, the control circuit 200 performs an automated media element calibration and an automated RFID calibration for the currently loaded media supply 110. In each of these aspects, the control circuit 200 collects the calibration data, stores it in a memory, and associates the calibration data with the new media profile. Then the user can name the new media profile. In at least one aspect, the new media profile comprises the calibration data.

When the label saver selection 408 (FIG. 4) is turned on by the user, the control circuit 200 executes a method that conserves media elements 302 upon a new/different media supply 110 being loaded into the media processing device 100. For example, with the label saver selection 408 turned "off" at least one media element 302 may be wasted during the loading and setup of a new media supply 110 and with the label saver selection 408 turned "on" a minimum number of media elements 302 wasted during the loading of a new media supply 110. In at least one aspect, no media elements 302 are wasted during the loading of a new media supply 110. In some instances, the first media element 302 may be damaged beyond use before the media supply 110 is loaded into the media processing device 100, where such a media element 302 must be discarded. However, such media waste is not related to the loading and setup of the media supply 110.

Figure 7:
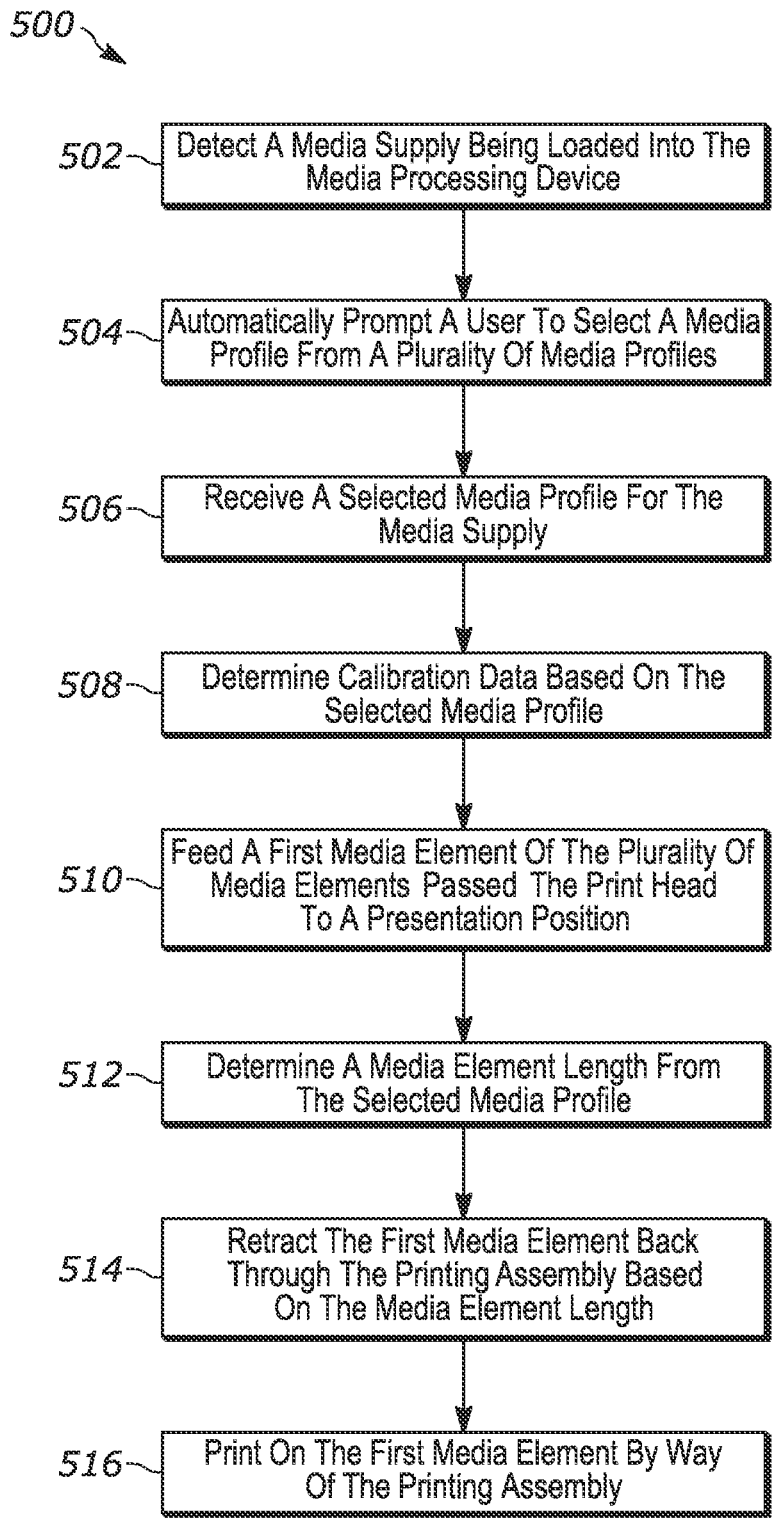
FIG. 7 is a flow diagram illustrating an example method that can be executed by a control circuit to control the media processing device, according to at least one aspect of the present disclosure

In at least one aspect, FIG. 7 is a flow diagram illustrating a method 500 that can be executed by the control circuit 200 to control the media processing device 100 to conserve media elements 302, according to at least one aspect of the present disclosure. The method 500 includes the control circuit 200 detecting 502 a media supply being loaded into the media processing device 100. In at least one aspect, the control circuit 200 detects the housing 102 being moved to an open configuration based on data from the housing sensor 124. For example, the housing 102 is generally placed in the open configuration for a new media supply 110 to be loaded. In an alternative aspect, the control circuit 200 receives data indicative of a new media supply being loaded. For example, the loading of a new media supply 110 could be automated and the control circuit 200 could receive data from an automated system of a new media supply 110 being loaded.

The method 500 further includes the control circuit 200 automatically prompting 504 a user to select a media profile from a plurality of media profiles. In at least one aspect, upon detecting a new media supply 110 being loaded, the control circuit 200 automatically causes the user display 210 to show the load media profile menu 420 for the user to select a stored media profile. The method 500 further includes the control circuit 200 receiving 506 a selected media profile for the media supply 110. In at least one aspect, the user selects a media profile from the load media profile menu 420 for the loaded media supply 110. In an alternative aspect, the control circuit 200 receives a media profile for the media supply 110 from an automated system.

In an alternative aspect, the control circuit 200 automatically causes the user display 210 to show the load media profile menu 420 upon detecting that the media processing device 100 has run out of the media supply 110. For example, the control circuit 200 can detect that the media supply 110 is empty and automatically prompt a user to load a new media supply 110 and select a media profile for the new media supply 110.

In yet another alternative aspect, the selection and loading of the media profile corresponding to the media supply 110 being loaded can be automated, for example, where the media supply 110 includes identifying information (e.g., on a label or in device, such as an RFID tag) and the media processing device 100 includes a media supply sensor 230 as described herein. For example, the control circuit 200 can automatically determine the media profile to use with a loaded media supply 110 based on identification data received from the media supply sensor 230.

The method 500 further includes the control circuit 200 determining 508 calibration data based on the selected media profile. In at least one aspect, the control circuit 200 determines the media element calibration data and the RFID calibration data from the selected media profile.

The method 500 further includes the control circuit 200 feeding 510 a first media element of the media elements 302 in the continuous strip 112 past the print head 132 to a presentation position. For example, the control circuit 200 can control the motor 136 to feed at least the first media element 302 of the continuous strip 112 past the printing head 132 and/or RFID encoder 138. In at least one aspect, the control circuit 200 stops feeding the continuous strip 112 of the media supply 110 through the printing assembly upon detecting a trailing edge of the first media element, a leading edge of a second media element of the media elements 302, or one or more markers, or other indications, associated with the trailing edge of the first media element and/or the leading edge of the second media element. For example, upon loading a media supply 110 into the housing 102 and printing assembly 130, the control circuit can feed one media element through the printing assembly 130 to ensure proper registration of the media edge position and ensure that media supply 110 is loaded properly. In at least one aspect, the continuous strip 112 is manually loaded into the printing assembly 130. In an alternative aspect, the continuous strip 112 is automatically loaded into the printing assembly 130 by the media processing device 100.

Figure 8:
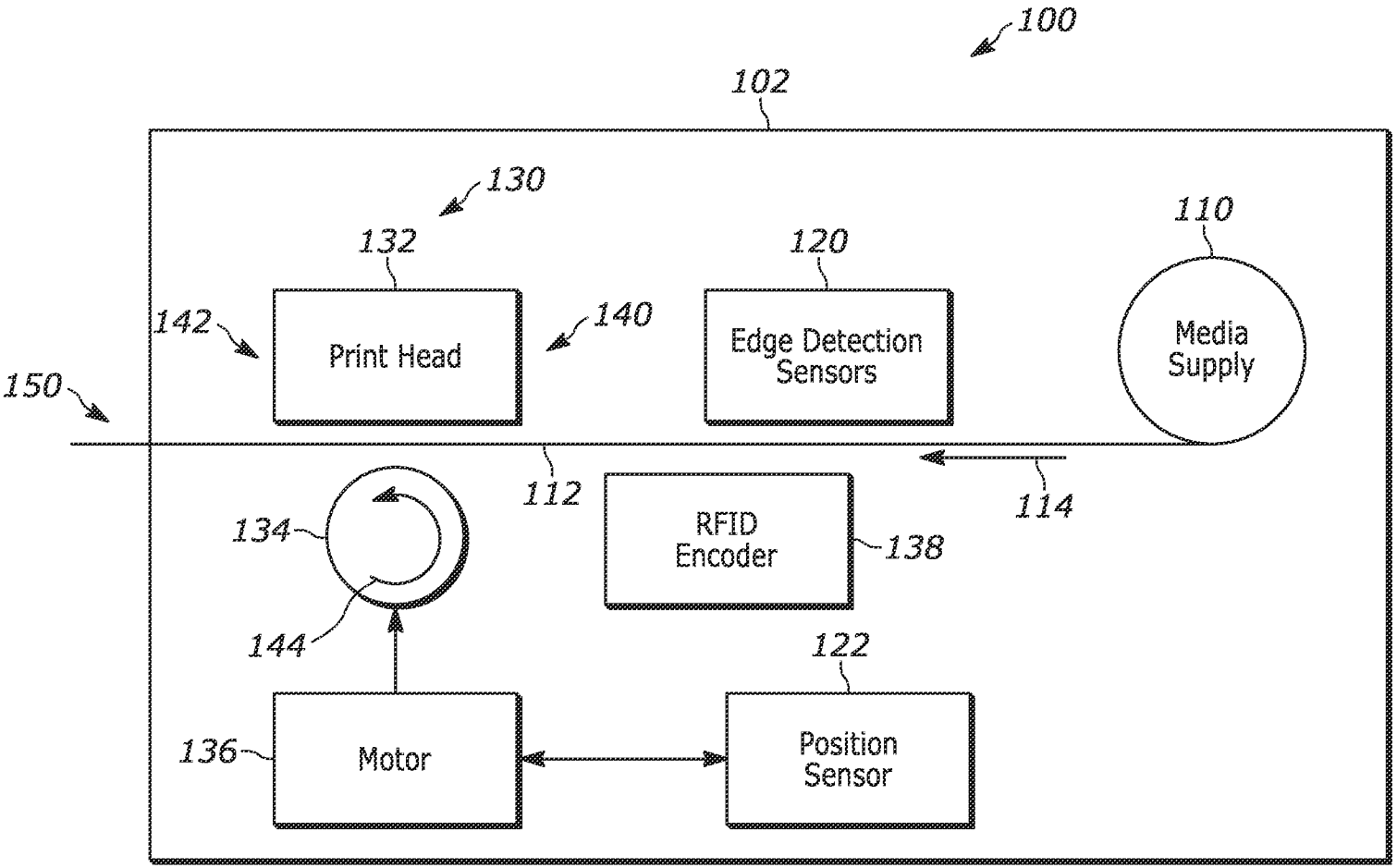
FIG. 8 is a schematic of a media processing device feeding a first media element through the printing and/or encoding assembly, according to at least one aspect of the present disclosure.

FIG. 8 is a schematic of the media processing device 100 feeding a first media element past the printing head 132 and/or the RFID encoder 138 via rotation of the platen 134, according to at least one aspect of the present disclosure. FIG. 8 illustrates the media processing device 100 feeding the continuous strip 112 downstream in the direction 114 past the printing head 132 and/or the RFID encoder 138. For example, the control circuit 200 can cause the motor 136 to rotate the platen 134 in a clockwise direction 144 (e.g., relative to its axis looking into FIG. 8) causing the continuous strip 112 to move downstream in the direction 114 through the printing assembly 130, past the print head 132 and/or the RFID encoder 138, toward a presentation position 150. This process moves a media element 302 to the presentation position 150. In some aspects, the presentation position 150 is outside of the housing 102. For example, the presentation position 150 can be a location where the media element 302 is cut off, peeled off, torn off, or by some other way removed from a liner or cut, torn, or separated from the next adjacent media element in the continuous strip 112 where no liner is present.

The method 500 further includes the control circuit 200 determining 512 a media element length from the selected media profile. For example, the media element length can be determined based on the calibration data stored in the media profile. The method 500 further includes the control circuit 200 retracting 514 the first media element back through the printing assembly 130 based on the media element length. For example, the control circuit 200 can control the motor 136 to retract the continuous strip 112 back through the printing assembly 130 to align the first media element with the print head 132 and/or the RFID encoder 138. In at least one aspect, the control circuit 200 retracts the continuous strip 112 until the continuous strip 112 has moved a distance equivalent to the media element length.

Figure 9:
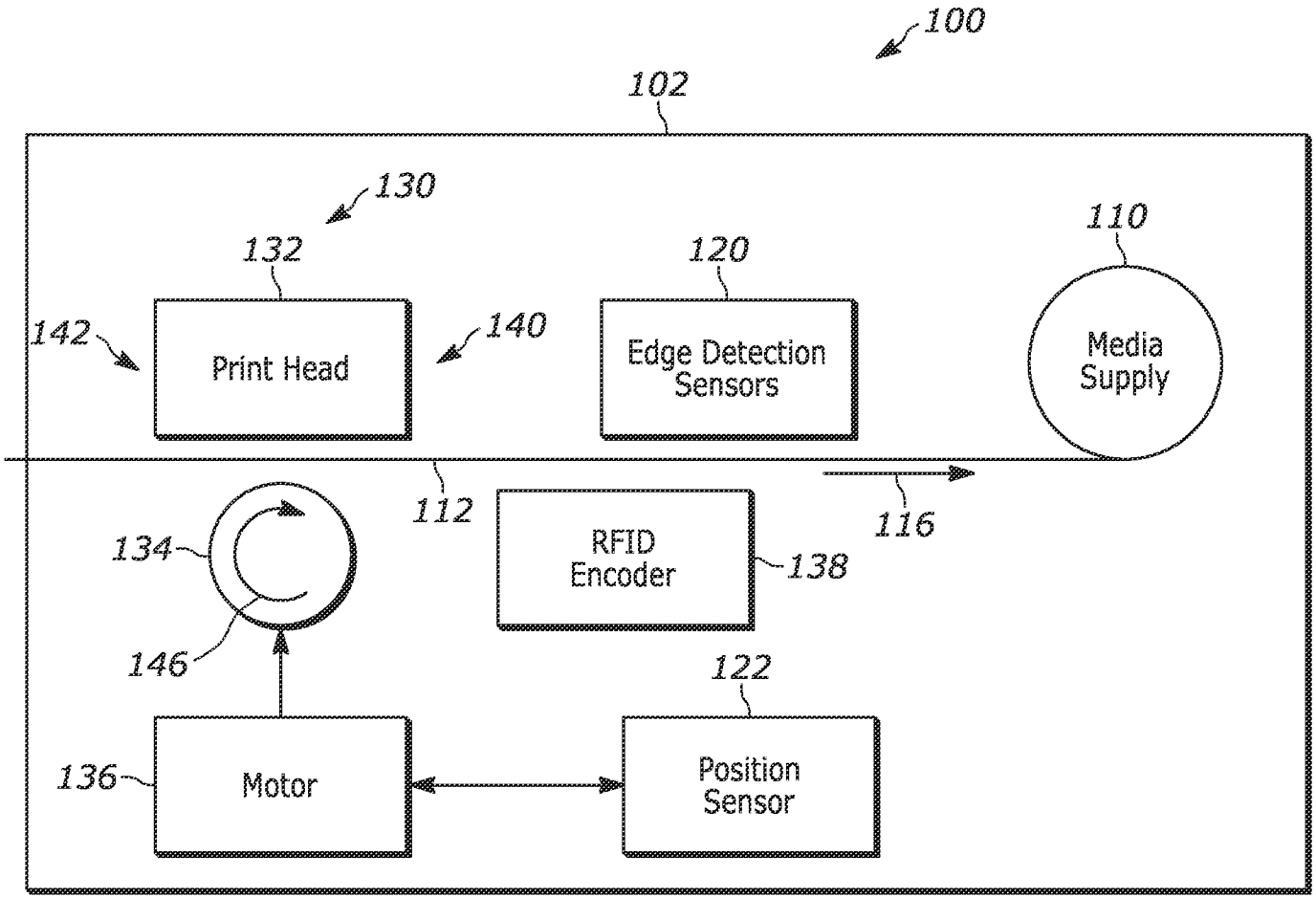
FIG. 9 is a schematic of a media processing device retracting the first media element back through the printing and/or encoding assembly based on a media element length, according to at least one aspect of the present disclosure.

FIG. 9 is a schematic of the media processing device 100 retracting the first media element back through the printing assembly 130 based on a media element length, according to at least one aspect of the present disclosure. FIG. 9 illustrates the media processing device 100 retracting the continuous strip 112 upstream in the direction 116 through the printing assembly 130. For example, the control circuit 200 can cause the motor 136 to rotate the platen 134 in a counter clockwise direction 146 (e.g., relative to its axis looking into FIG. 8) causing the continuous strip 112 to move upstream in the direction 116 through the printing assembly 130. This process occurs prior to the first media element being removed from the continuous strip 112 to position the leading edge of the first media element proximate to and/or aligned with the print head 132 and/or the RFID encoder 138 so that the first media element is in position for the print head 132 to print on the first media element and/or for the RFID encoder 138 to write to and/or read from an RFID inlay of the first media element. As such, the first media element is not wasted.

The method 500 further includes the control circuit 200 printing 516 on the first media element by way of the printing assembly 130. In some aspects, the method 500 further or alternatively includes the control circuit encoding an RFID inlay of the first media element by way of the RFID encoder 138. For example, the data encoded in the RFID inlay could include package contents, security in-store alert, shipping information, and/or etc.

In the foregoing detailed description, specific embodiments have been described. However, one of ordinary skill in the art appreciates that various modifications and changes can be made without departing from the scope of the disclosure as set forth in the claims below. Accordingly, the specification and figures are to be regarded in an illustrative rather than a restrictive sense, and all such modifications are intended to be included within the scope of present teachings.

The benefits, advantages, solutions to problems, and any element(s) that may cause any benefit, advantage, or solution to occur or become more pronounced are not to be construed as a critical, required, or essential features or elements of any or all the claims. The invention is defined solely by the appended claims including any amendments made during the pendency of this application and all equivalents of those claims as issued.

The foregoing detailed description has set forth various forms of the systems and/or processes via the use of block diagrams, flowcharts, and/or examples. Insofar as such block diagrams, flowcharts, and/or examples contain one or more functions and/or operations, it will be understood by those within the art that each function and/or operation within such block diagrams, flowcharts, and/or examples can be implemented, individually and/or collectively, by a wide range of hardware, software, firmware, or virtually any combination thereof. Those skilled in the art will recognize that some aspects of the forms disclosed herein, in whole or in part, can be equivalently implemented in integrated circuits, as one or more computer programs running on one or more computers (e.g., as one or more programs running on one or more computer systems), as one or more programs running on one or more processors (e.g., as one or more programs running on one or more microprocessors), as firmware, or as virtually any combination thereof, and that designing the circuitry and/or writing the code for the software and or firmware would be well within the skill of one of skill in the art in light of this disclosure. In addition, those skilled in the art will appreciate that the mechanisms of the subject matter described herein are capable of being distributed as one or more program products in a variety of forms, and that an illustrative form of the subject matter described herein applies regardless of the particular type of signal bearing medium used to actually carry out the distribution.

Instructions used to program logic to perform various disclosed aspects can be stored within a memory in the system, such as dynamic random access memory (DRAM), cache, flash memory, or other storage. Furthermore, the instructions can be distributed via a network or by way of other computer readable media. Thus a machine-readable medium may include any mechanism for storing or transmitting information in a form readable by a machine (e.g., a computer), but is not limited to, floppy diskettes, optical disks, compact disc, read-only memory (CD-ROMs), and magneto-optical disks, read-only memory (ROMs), random access memory (RAM), erasable programmable read-only memory (EPROM), electrically erasable programmable read-only memory (EEPROM), magnetic or optical cards, flash memory, or a tangible, machine-readable storage used in the transmission of information over the Internet via electrical, optical, acoustical or other forms of propagated signals (e.g., carrier waves, infrared signals, digital signals, etc.). Accordingly, the non-transitory computer-readable medium includes any type of tangible machine-readable medium suitable for storing or transmitting electronic instructions or information in a form readable by a machine (e.g., a computer).

Any of the software components or functions described in this application, may be implemented as software code to be executed by a processor using any suitable computer language such as, for example, Python, Java, C++ or Perl using, for example, conventional or object-oriented techniques. The software code may be stored as a series of instructions, or commands on a computer readable medium, such as RAM, ROM, a magnetic medium such as a hard-drive or a floppy disk, or an optical medium such as a CD-ROM. Any such computer readable medium may reside on or within a single computational apparatus, and may be present on or within different computational apparatuses within a system or network.

As used in any aspect herein, the term "logic" may refer to an app, software, firmware and/or circuitry configured to perform any of the aforementioned operations. Software may be embodied as a software package, code, instructions, instruction sets and/or data recorded on non-transitory computer readable storage medium. Firmware may be embodied as code, instructions or instruction sets and/or data that are hard-coded (e.g., nonvolatile) in memory devices.

As used in any aspect herein, the terms "component," "system," "module" and the like can refer to a computer-related entity, either hardware, a combination of hardware and software, software, or software in execution.

As used in any aspect herein, an "algorithm" refers to a self-consistent sequence of steps leading to a desired result, where a "step" refers to a manipulation of physical quantities and/or logic states which may, though need not necessarily, take the form of electrical or magnetic signals capable of being stored, transferred, combined, compared, and otherwise manipulated. It is common usage to refer to these signals as bits, values, elements, symbols, characters, terms, numbers, or the like. These and similar terms may be associated with the appropriate physical quantities and are merely convenient labels applied to these quantities and/or states.

Unless specifically stated otherwise as apparent from the foregoing disclosure, it is appreciated that, throughout the present disclosure, discussions using terms such as "processing," "computing," "calculating," "determining," "displaying," or the like, refer to the action and processes of a computer system, or similar electronic computing device, that manipulates and transforms data represented as physical (electronic) quantities within the computer system's registers and memories into other data similarly represented as physical quantities within the computer system memories or registers or other such information storage, transmission or display devices.

Moreover in this document, relational terms such as first and second, top and bottom, and the like may be used solely to distinguish one entity or action from another entity or action without necessarily requiring or implying any actual such relationship or order between such entities or actions. The terms "comprises," "comprising," "has", "having," "includes", "including," "contains", "containing" or any other variation thereof, are intended to cover a non-exclusive inclusion, such that a process, method, article, or apparatus that comprises, has, includes, contains a list of elements does not include only those elements but may include other elements not expressly listed or inherent to such process, method, article, or apparatus. An element proceeded by "comprises . . . a", "has . . . a", "includes . . . a", "contains . . . a" does not, without more constraints, preclude the existence of additional identical elements in the process, method, article, or apparatus that comprises, has, includes, contains the element. The terms "a" and "an" are defined as one or more unless explicitly stated otherwise herein. The terms "substantially", "essentially", "approximately", "about" or any other version thereof, are defined as being close to as understood by one of ordinary skill in the art, and in one non-limiting embodiment the term is defined to be within 10%, in another embodiment within 5%, in another embodiment within 1% and in another embodiment within 0.5%. The term "coupled" as used herein is defined as connected, although not necessarily directly and not necessarily mechanically. A device or structure that is "configured" in a certain way is configured in at least that way, but may also be configured in ways that are not listed.

In addition, even if a specific number of an introduced claim recitation is explicitly recited, those skilled in the art will recognize that such recitation should typically be interpreted to mean at least the recited number (e.g., the bare recitation of "two recitations," without other modifiers, typically means at least two recitations, or two or more recitations). Furthermore, in those instances where a convention analogous to "at least one of A, B, and C, etc." is used, in general such a construction is intended in the sense one having skill in the art would understand the convention (e.g., "a system having at least one of A, B, and C" would include but not be limited to systems that have A alone, B alone, C alone, A and B together, A and C together, B and C together, and/or A, B, and C together, etc.). In those instances where a convention analogous to "at least one of A, B, or C, etc." is used, in general such a construction is intended in the sense one having skill in the art would understand the convention (e.g., "a system having at least one of A, B, or C" would include but not be limited to systems that have A alone, B alone, C alone, A and B together, A and C together, B and C together, and/or A, B, and C together, etc.). It will be further understood by those within the art that typically a disjunctive word and/or phrase presenting two or more alternative terms, whether in the description, claims, or drawings, should be understood to contemplate the possibilities of including one of the terms, either of the terms, or both terms unless context dictates otherwise. For example, the phrase "A or B" will be typically understood to include the possibilities of "A" or "B" or "A and B."

As used in any aspect herein, the term "control circuit" may refer to, for example, hardwired circuitry, programmable circuitry (e.g., a computer processor including one or more individual instruction processing cores, processing unit, processor, microcontroller, microcontroller unit, controller, digital signal processor (DSP), programmable logic device (PLD), programmable logic array (PLA), or field programmable gate array (FPGA)), state machine circuitry, firmware that stores instructions executed by programmable circuitry, and any combination thereof. The control circuit may, collectively or individually, be embodied as circuitry that forms part of a larger system, for example, an integrated circuit (IC), an application-specific integrated circuit (ASIC), a system on-chip (SoC), desktop computers, laptop computers, tablet computers, servers, smart phones, etc. Accordingly, as used herein "control circuit" includes, but is not limited to, electrical circuitry having at least one discrete electrical circuit, electrical circuitry having at least one integrated circuit, electrical circuitry having at least one application specific integrated circuit, electrical circuitry forming a general purpose computing device configured by a computer program (e.g., a general purpose computer configured by a computer program which at least partially carries out processes and/or devices described herein, or a microprocessor configured by a computer program which at least partially carries out processes and/or devices described herein), electrical circuitry forming a memory device (e.g., forms of random access memory), and/or electrical circuitry forming a communications device (e.g., a modem, communications switch, or optical-electrical equipment). Those having skill in the art will recognize that the subject matter described herein may be implemented in an analog or digital fashion or some combination thereof.

As used in any aspect herein, the terms "component," "system," "module" and the like can refer to a computer-related entity, either hardware, a combination of hardware and software, software, or software in execution.

It will be appreciated that some embodiments may be comprised of one or more specialized processors (or "processing devices") such as microprocessors, digital signal processors, customized processors and field programmable gate arrays (FPGAs) and unique stored program instructions (including both software and firmware) that control the one or more processors to implement, in conjunction with certain non-processor circuits, some, most, or all of the functions of the method and/or apparatus described herein. Alternatively, some or all functions could be implemented by a state machine that has no stored program instructions, or in one or more application specific integrated circuits (ASICs), in which each function or some combinations of certain of the functions are implemented as custom logic. Of course, a combination of the two approaches could be used.

Moreover, an embodiment can be implemented as a computer-readable storage medium having computer readable code stored thereon for programming a computer (e.g., comprising a processor) to perform a method as described and claimed herein. Examples of such computer-readable storage mediums include, but are not limited to, a hard disk, a CD-ROM, an optical storage device, a magnetic storage device, a ROM (Read Only Memory), a PROM (Programmable Read Only Memory), an EPROM (Erasable Programmable Read Only Memory), an EEPROM (Electrically Erasable Programmable Read Only Memory) and a Flash memory. Further, it is expected that one of ordinary skill, notwithstanding possibly significant effort and many design choices motivated by, for example, available time, current technology, and economic considerations, when guided by the concepts and principles disclosed herein will be readily capable of generating such software instructions and programs and ICs with minimal experimentation.

It is worthy to note that any reference to "one aspect," "an aspect," "an exemplification," "one exemplification," and the like means that a particular feature, structure, or characteristic described in connection with the aspect is included in at least one aspect. Thus, appearances of the phrases "in one aspect," "in an aspect," "in an exemplification," and "in one exemplification" in various places throughout the specification are not necessarily all referring to the same aspect. Furthermore, the particular features, structures or characteristics may be combined in any suitable manner in one or more aspects.

The Abstract of the Disclosure is provided to allow the reader to quickly ascertain the nature of the technical disclosure. It is submitted with the understanding that it will not be used to interpret or limit the scope or meaning of the claims. In addition, in the foregoing Detailed Description, it can be seen that various features are grouped together in various embodiments for the purpose of streamlining the disclosure. This method of disclosure is not to be interpreted as reflecting an intention that the claimed embodiments require more features than are expressly recited in each claim. Rather, as the following claims reflect, inventive subject matter lies in less than all features of a single disclosed embodiment. Thus the following claims are hereby incorporated into the Detailed Description, with each claim standing on its own as a separately claimed subject matter.

What is claimed is:

1. A media processing device, comprising:

a printing assembly located downstream of a media supply, the media supply comprises a plurality of media elements arranged end-to-end in a continuous strip, and the printing assembly is configured to sequentially receive the plurality of media elements at an upstream end of the printing assembly, sequentially feed the plurality of media elements past the printing assembly, and sequentially eject the plurality of media elements from a downstream end of the printing assembly;

a memory configured to store a plurality of media profiles;

an edge detection sensor configured to detect edges of the plurality of media elements, wherein the edge detection sensor is located proximate to the upstream end of the printing assembly; and a control circuit configured to:

receive an input requesting a new media profile be created for the media supply;

perform media calibration with the media supply;

store media calibration data in the new media profile;

receive the new media profile for the media supply, wherein the media profile corresponds to media profile data;

determine calibration data based on the media profile data;

feed a first media element of the plurality of media elements of the continuous strip through the printing assembly and downstream of the printing assembly to a presentation position;

determine a media element length based on the media profile data;

retract the first media element back through the printing assembly based on the media element length; and print on the first media element by way of the printing assembly.

2. The media processing device of claim 1, wherein the control circuit is further configured to:

detect the media supply being loaded into the media processing device; and automatically prompt a user to select from a plurality of media profiles or request that the new media profile be created.

3. The media processing device of claim 1, further comprising:

an RFID encoder, wherein each media element of the plurality of media elements comprises an RFID inlay, and wherein the control circuit is further configured to cause the RFID encoder to encode the RFID inlay in the first media element.

4. The media processing device of claim 3, wherein the control circuit is further configured to:

perform RFID calibration; and store RFID calibration data in the new media profile.

5. The media processing device of claim 1, wherein during the media calibration, the control circuit is configured to:

detect a first edge of the first media element based on an output from the edge detection sensor;

feed the continuous strip through the printing assembly until a second edge is detected on a second media element of the plurality of media elements based on the output from the edge detection sensor;

determine the media element length of the first media element; and store a value for the media element length in the new media profile.

6. The media processing device of claim 5, wherein the edge detection sensor detects the first edge and the second edge by way of one or more delineating features on the first media element, the second media element, or disposed proximate to the first edge of the first media element and the second edge of the second media element, and the printing assembly comprises a platen, wherein the media processing device further comprises a motor operatively coupled to the platen of the printing assembly, and wherein the control circuit is further configured to control the motor to drive the platen to move the continuous strip upstream or downstream.

7. The media processing device of claim 6, wherein the media element length is determined based on an input to the motor.

8. The media processing device of claim 6, wherein the media processing device further comprises a media position sensor configured to collect data indicative of an amount of media supply moved through the printing assembly, and wherein the media element length is determined based on data received by the control circuit from the media position sensor.

9. The media processing device of claim 1, wherein the control circuit is communicably coupled to at least one other media processing device, and wherein the control circuit is further configured to receive one of a plurality of media profiles from the at least one other media processing device.

10. The media processing device of claim 1, wherein the control circuit is communicably coupled to a removable memory, and wherein the control circuit is further configured to receive the media profile from the removable memory.

11. The media processing device of claim 1, wherein a first media element of the plurality of media elements is manually fed into the printing assembly, and the control circuit is configured to:

feed the first media element through the printing assembly to the presentation position; and stop feeding the media supply through the printing assembly upon detecting a trailing edge of the first media element or a leading edge of a second media element of the plurality of media elements.

12. A method, comprising:

detecting a media supply being loaded into a media processing device, wherein the media supply comprises a plurality of media elements arranged end-to-end in a continuous strip;

receiving an input requesting a new media profile be created for the media supply;

performing media calibration with the media supply;

storing media calibration data in the new media profile;

receiving the new media profile for the media supply;

determining calibration data based on the new media profile stored in a memory of the media processing device;

determining a media element length from the new media profile;

feeding a first media element of the plurality of media elements of the continuous strip through a printing assembly and downstream of the printing assembly to a presentation position;

retracting the first media element back through the printing assembly based on the media element length; and printing on the first media element by way of the printing assembly.

13. The method of claim 12, further comprising automatically prompting a user to select from a plurality of media profiles based on the detection of a media supply being loaded into the media processing device or request that the new media profile be created.

14. The method claim 12, further comprising causing an RFID encoder to encode an RFID inlay in the first media element, wherein each media element of the plurality of media elements comprises an RFID inlay.

15. The method claim 14, further comprising:

performing RFID calibration with an RFID encoder; and storing RFID calibration data in the new media profile.

16. The method of claim 12, wherein during the media calibration, the method further comprises:

detecting a first edge of the first media element based on an output from an edge detection sensor;

feeding the continuous strip through the printing assembly until a second edge is detected on a second media element of the plurality of media elements based on the output from the edge detection sensor;

determining the media element length of the first media element; and storing a value for the media element length in the new media profile.

17. The method of claim 12, further comprising:

communicating with at least one other media processing device; and receiving one of a plurality of media profiles from the at least one other media processing device.

18. A media processing device, comprising:

a user display;

a printing assembly located downstream of a media supply, wherein the media supply comprises a plurality of media elements arranged end-to-end in a continuous strip, and wherein the printing assembly is configured to sequentially receive the plurality of media elements at an upstream end of the printing assembly, sequentially feed the plurality of media elements past the printing assembly, and sequentially eject the plurality of media elements from a downstream end of the printing assembly, a memory configured to store a plurality of media profiles;

an edge detection sensor configured to detect edges of the plurality of media elements, the edge detection sensor is located proximate to the upstream end of the printing assembly;

a housing configured to house the printing assembly and the media supply, wherein the housing is configured to move from a closed configuration to an open configuration to allow a new media supply to be loaded;

a housing sensor configured to determine if the housing is in the open configuration or the closed configuration; and a control circuit configured to:

detect the housing being in the open configuration;

automatically display on the user display a prompt for a user to input a media profile of the plurality of media profiles in response to the housing being in the open configuration;

receive a selected media profile from the user for the media supply;

determine calibration data based on the selected media profile;

feed a first media element of the plurality of media elements of the continuous strip through the printing assembly and downstream of the printing assembly to a presentation position;

determine a media element length from the selected media profile;

retract the first media element back through the printing assembly based on the media element length; and print on the first media element by way of the printing assembly.

19. The media processing device of claim 18, further comprising:

an RFID encoder, wherein each media element of the plurality of media elements comprises an RFID inlay, and wherein the control circuit is further configured to cause the RFID encoder to encode the RFID inlay in the first media element.

20. The media processing device of claim 18, wherein the control circuit is communicably coupled to at least one other media processing device, and wherein the control circuit is further configured to receive the media profile from the at least one other media processing device.

* * * * *